US007273416B2

(12) United States Patent
Peek

(10) Patent No.: US 7,273,416 B2
(45) Date of Patent: Sep. 25, 2007

(54) GOLF TRAINING APPARATUS

(76) Inventor: Ian Peek, Roemerstrasse 22/1, 72488 Sigmaringen (DE)

( * ) Notice: Subject to any disclaimer, the term of this patent is extended or adjusted under 35 U.S.C. 154(b) by 417 days.

(21) Appl. No.: 10/762,413

(22) Filed: Jan. 22, 2004

(65) Prior Publication Data

US 2004/0185957 A1 Sep. 23, 2004

(30) Foreign Application Priority Data

Mar. 19, 2003 (DE) ..... 203 04 418 U

(51) Int. Cl.
*A63B 69/36* (2006.01)

(52) U.S. Cl. ..... 473/257; 473/265

(58) Field of Classification Search ..... 473/257, 473/261, 263, 265, 266, 269, 219, 273; 446/220, 446/226; 273/394; D21/699
See application file for complete search history.

(56) References Cited

U.S. PATENT DOCUMENTS 2,592,347 A * 4/1952 Shute ..... 446/220
3,375,010 A 3/1968 Panza
3,554,555 A * 1/1971 Macri ..... 473/264
3,768,501 A * 10/1973 Elson et al. ..... 137/231
4,634,395 A * 1/1987 Burchett ..... 446/222
5,005,826 A * 4/1991 Merrick ..... 482/10
5,013,044 A * 5/1991 Hesselbart ..... 473/218
D324,554 S * 3/1992 McKinney ..... D21/699
5,303,926 A * 4/1994 Owens et al. ..... 473/261
5,375,833 A * 12/1994 Marier, Jr. ..... 473/261
5,720,669 A * 2/1998 Pearson ..... 473/265
5,899,816 A 5/1999 Pearson
D410,713 S * 6/1999 Sherwood et al. ..... D21/699
6,343,998 B1 * 2/2002 Tarulli et al. ..... 473/273
6,458,041 B1 10/2002 Brandt

FOREIGN PATENT DOCUMENTS

DE 36 26 829 A1 2/1988

* cited by examiner

*Primary Examiner*—Nini F. Legesse
(74) *Attorney, Agent, or Firm*—Michael J. Striker

(57) ABSTRACT

A golf training apparatus for practicing straight hits has an upright rack, a rod provided on the rack and aligned substantially horizontally and parallel to a desired hitting direction, the rod being arranged at a distance to the rack such that a golf club is swingable through underneath the rod.

1 Claim, 2 Drawing Sheets

GOLF TRAINING APPARATUS

BACKGROUND OF THE INVENTION

The present invention relates to a golf training apparatus.

One of the main difficulties in playing golf is hitting the golf ball in a straight direction, 85% of all golfers tend to swing the golf club from outside to inside, resulting in the ball flying from left to right, which is called a "slice". Executing a swing from inside to outside results in the ball flying from right to left. An exact direction of flight is only obtained if the club is guided in a plane in the intended direction of flight of the ball.

SUMMARY OF THE INVENTION

The object of the present invention is to develop a training apparatus for practicing the hitting of golf balls in the proper direction.

In keeping with these objects and with others, one feature of the present invention resides in a golf training apparatus for practicing straight hits with a rack, which has a rod aligned horizontally and parallel to the desired hitting direction, wherein the rod is fastened to a rack at a distance to the rack, such that the golf club may be swung through underneath the rod. Thus, the rod is an optical guiding aid for the golfer.

In accordance with the invention, It is advantageous if the rod is disposed approximately at the height of the forearm, since this measure enables a particularly good optical control of ones arm movement. The rod thereby defines the correct direction of stance for the player. The training apparatus is also suited as aid for the so called short game, i.e. for shorter approaching hits.

In accordance with the invention, in order to avoid the risk of injuries of the golfer, at least the rod, preferably also the extension, may be formed by an inflatable foil hose. Should the golfer execute his hit too close to the rod and thus touch the rod, the soft foil tube just gives way. This allows the golfer to execute his hit without hindering due to feared injuries by the training apparatus.

The inventive inflatable embodiment of the rod and the extension as the further advantage that the training apparatus does not take up much space if not in use.

In accordance with the invention, in order to still ensure fast putting into service, an airpump, which may preferably be manually operatable, may be disposed at the rack.

In accordance with the invention, further advantages arise if the rack is adjustable in height. Thus, it may be easily adjusted to golfers or different height. The extension may also be extendably disposed on the rack, in order to be able to vary the distance of the rod from the rack. Furthermore, it is useful if the whole training apparatus is dismountable, such that it may be easily be transported in the boot of a car or in the baggage.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
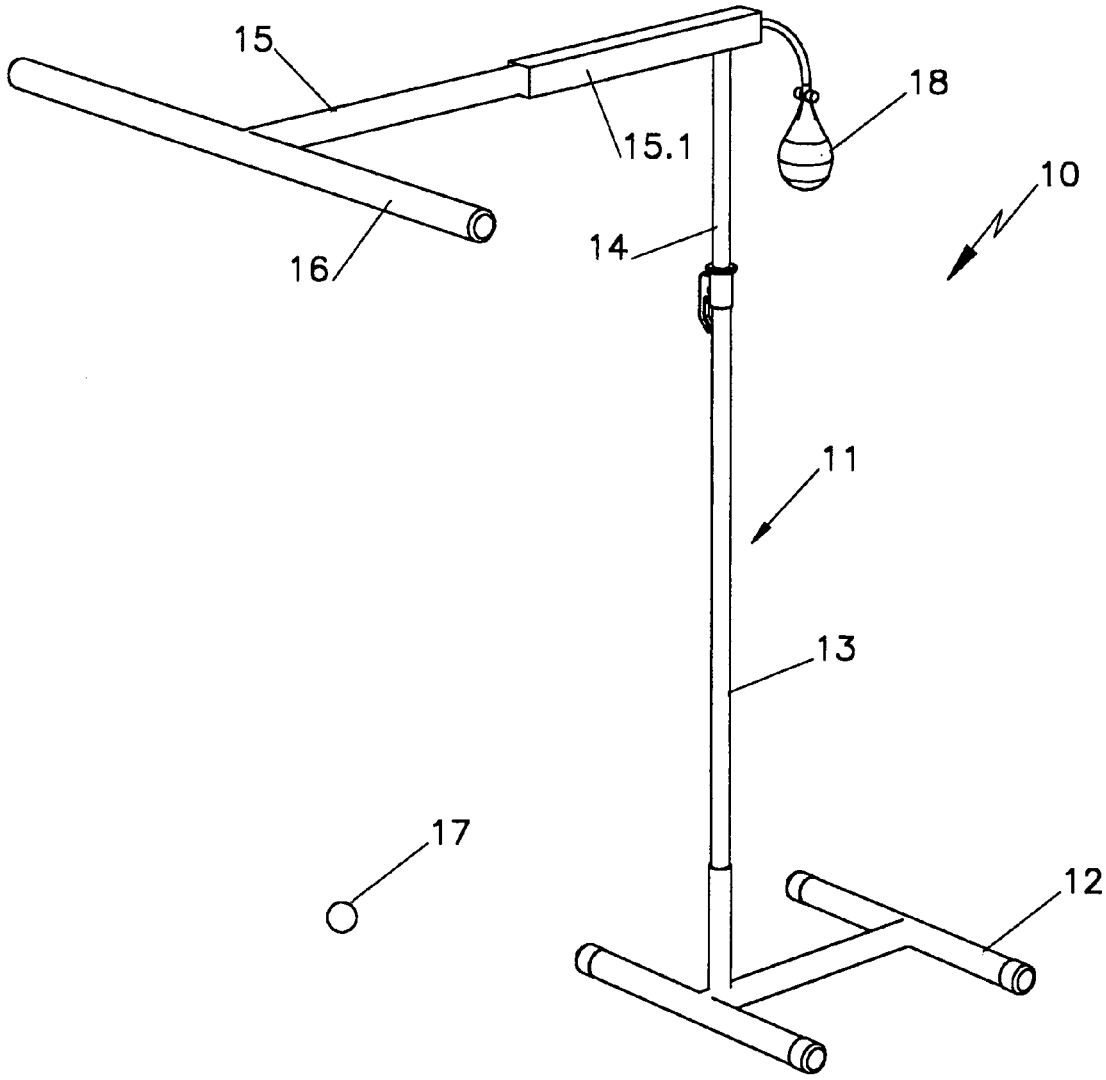
FIG. 1 is a view showing a perspective view of a first embodiment of a training apparatus in accordance with the present invention.

FIG. 1 shows a golf training apparatus 10 with a rack 11 comprising a footing 12, a vertical tube 13 and a tube 14 extendable therefrom and lockable. An extension 15 is fixed to the extendable tube 14 and carries a horizontal rod 16 at its front end. The rod 16 and the extension 15 are made of a foil tube and are inflatable. For inflating a manually operatable air pump 18 is disposed at a section 15.1 of the extension 15.

The rod 16 is disposed approximately at the height of the forearm of a golfer. The distance of the rod 16 from the rack 11 is such that the golf club may be comfortably swung through underneath the rod 16. Thus, a golf ball 17 may be put on the ground underneath the rod 16 and the rod 16 may be used as an optical control for an absolutely straight execution of the club swing.

Since the rod 16 and the extension 15 are formed as foil tubes, touching of the rod 16 by the golfer is harmless and not accompanied with a risk of injuries. Due to the tube 14 being extendable from the tube 13 and due to the locking means 19, which can be formed as conventional locking means, the rod 16 may be easily adjusted in its height to golfers of different height.

The tube 13 may also be completely extracted from tube 14 such that the rack 11 is dismountable. The rod 16 and the extension 15 take up little space in the unfilled state such that the training apparatus may be stored in a space-saving manner if not in use, and may be easily transported.

Figure 2:
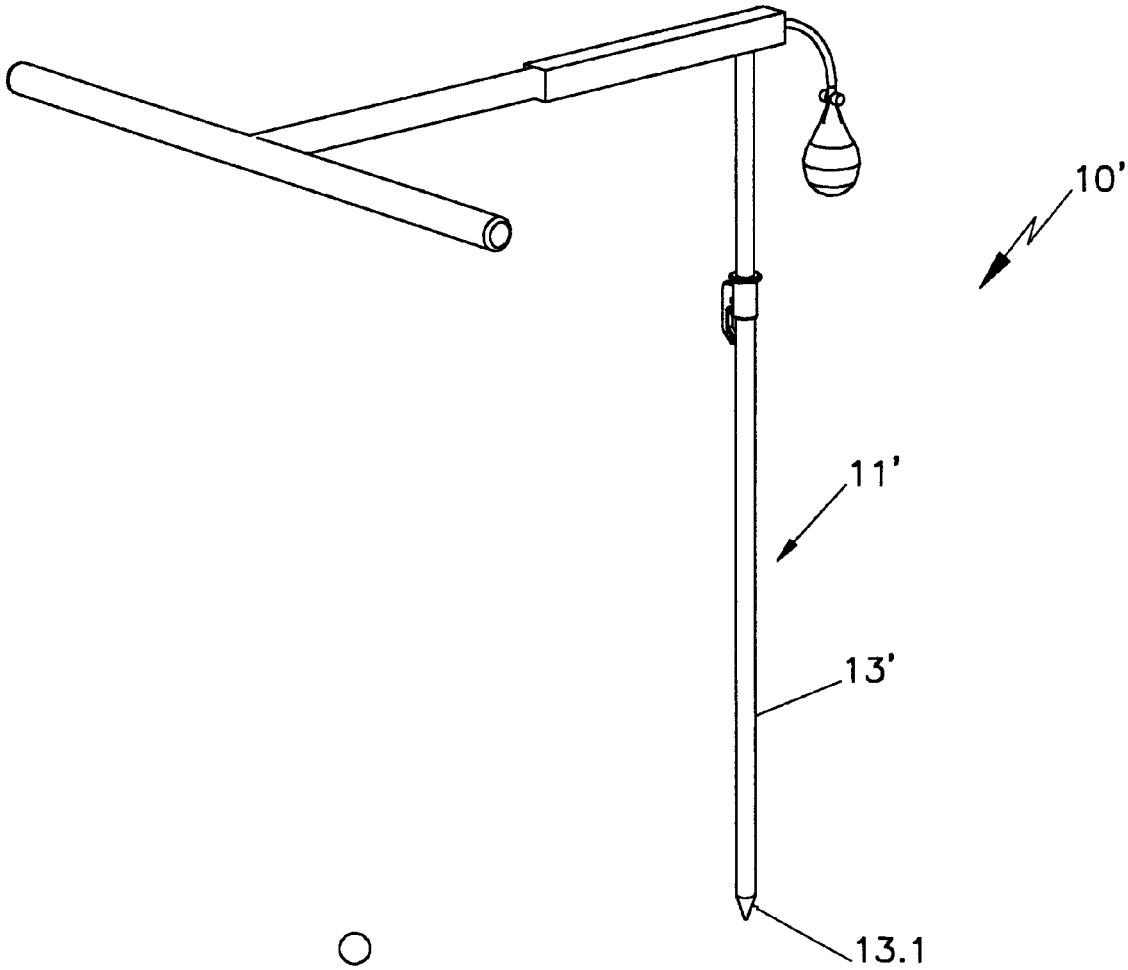
FIG. 2 is a view showing a perspective view of a second embodiment of a training apparatus in accordance with the present invention.

The second embodiment 10' of a golf training apparatus shown in FIG. 2 differs from the golf training apparatus 10 of FIG. 1 in that the tube 13' of the rack 11' does not comprise a footing 12, but instead has a point 13.1, by means of which the tube 13' may be pushed into the ground.

It will be understood that each of the elements described above, or two or more together, may also find a useful application in other types of constructions differing from the types described above.

While the invention has been illustrated and described as embodied in golf training apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A golf training apparatus for practicing straight hits, comprising:

an upright rack made of a rigid material; and a rod provided on said upright rack and aligned substantially horizontally and parallel to a desired hitting direction, said rod being arranged at a distance to said upright rack such that a golf club is swingable through underneath said rod, and while said rack being rigid said rod being inflatable such that touching said inflatable rod by a golfer is harmless and not accompanied by a risk of injuries.

* * * * *